US005368719A

United States Patent [19]

Troup-Packman

[11] Patent Number: 5,368,719

[45] Date of Patent: Nov. 29, 1994

[54] METHOD FOR DIRECT PLATING OF IRON ON ALUMINUM

[75] Inventor: Sue Troup-Packman, Calabasas, Calif.

[73] Assignee: Hughes Aircraft Company, Los Angeles, Calif.

[21] Appl. No.: 61,353

[22] Filed: May 12, 1993

[51] Int. Cl.[5] ..... C25D 5/30

[52] U.S. Cl. ..... 205/213; 205/219; 205/153

[58] Field of Search ..... 205/205, 270, 213, 219, 205/153, 137

[56] References Cited

U.S. PATENT DOCUMENTS

| | | | |
|---|---|---|---|
| 2,827,399 | 3/1958 | Eisenberg | 427/437 |
| 3,202,529 | 8/1965 | Dunlap, Jr. et al. | 427/305 |
| 4,194,913 | 3/1980 | Davis | 204/254 |
| 4,346,128 | 8/1982 | Loch | 427/328 |
| 4,545,834 | 10/1985 | Schemenski et al. | 205/177 |
| 4,567,066 | 1/1986 | Schultz et al. | 427/305 |
| 4,960,493 | 10/1990 | Troup | 205/181 |

FOREIGN PATENT DOCUMENTS

| | | |
|---|---|---|
| 747321 | 11/1966 | Canada . |
| 1436855 | 5/1976 | United Kingdom . |

OTHER PUBLICATIONS

Metal Finishing Guidebook–Directory Issue 1992, vol. 90, No. 1A, pp. 157–158.

*Electroplating Engineering Handbook, Fourth Edition*, edited by Larry Durney, pp. 185–188.

R. H. Williams, "Iron Plating", in Metal Finishing Guidebook–Directory Issue 1992, vol. 90, No. 1A, Michael Murphy Ed., pp. 223, 224, 226 (Jan. 1992).

*Primary Examiner*—John Niebling

*Assistant Examiner*—Edna Wong

*Attorney, Agent, or Firm*—V. D. Duraiswamy; W. K. Denson-Low

[57] ABSTRACT

A process for plating aluminum and aluminum alloy substrates, such as 390 aluminum alloy pistons, with iron comprises (a) cathodically activating the aluminum-containing substrate in an acid bath and (b) plating iron from an iron sulfate-containing bath,

17 Claims, 1 Drawing Sheet

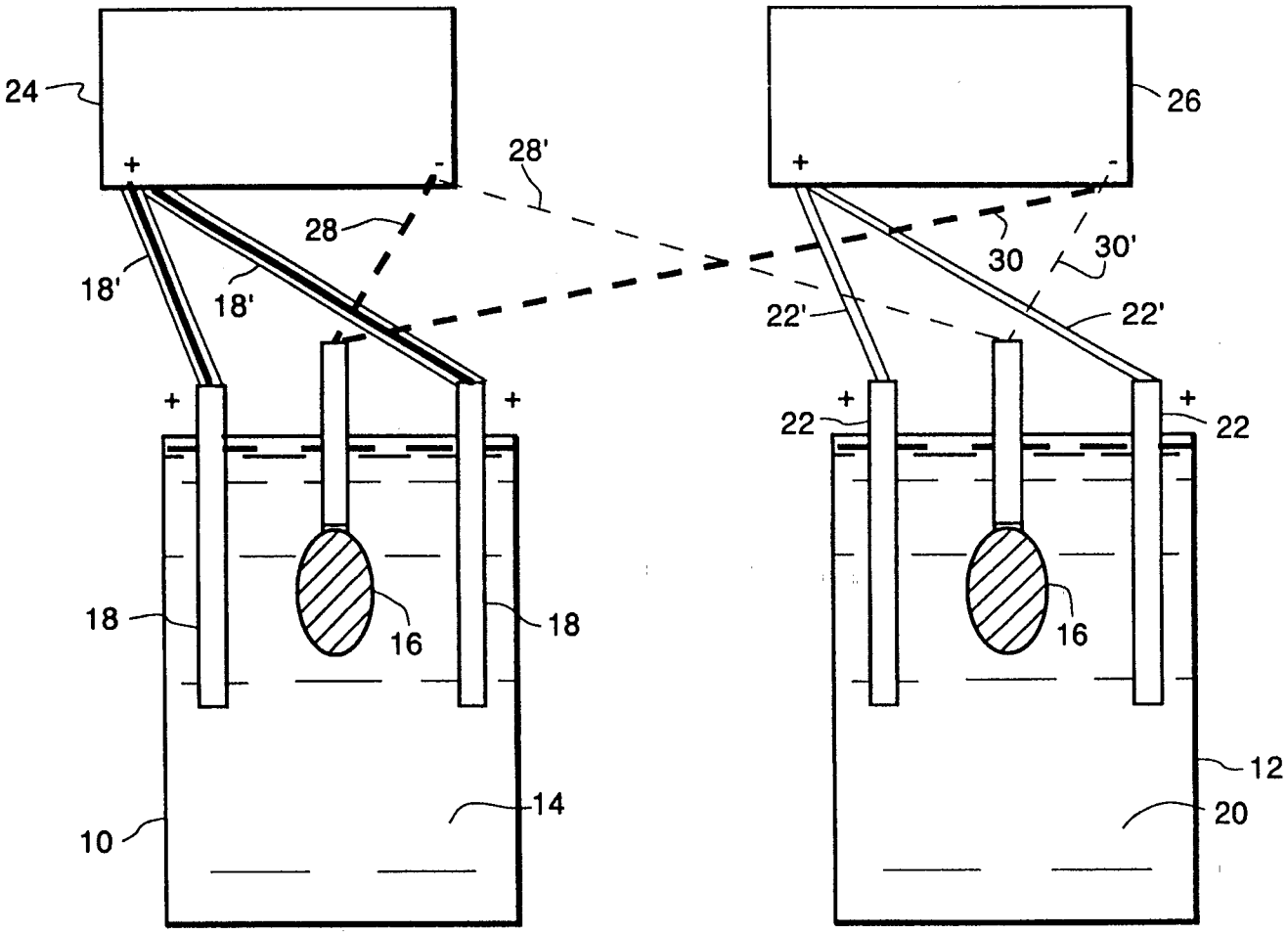
26
30'
22'
30
22
12
20
16
22'
22
28'
28
18'
18'
24
18
16
18
14
10

METHOD FOR DIRECT PLATING OF IRON ON ALUMINUM

BACKGROUND OF THE INVENTION

1. Field of the Invention

The present invention relates to the plating of aluminum and aluminum alloys, and, more particularly, to the plating of 390 aluminum alloys with iron.

2. Description of Related Art

The automotive industry is investigating the use of aluminum engines with aluminum pistons to reduce the weight of the vehicle and to meet fuel economy requirements. However, it is essential that either the piston or the cylinder bore be coated with a metal harder than aluminum to prevent piston skirt scuffing during cold starts. Therefore, an inexpensive, environmentally sound method of plating the piston with iron would be valuable.

Presently, an iron coating is plated onto the surface of the aluminum pistons, generally employing a copper undercoat. In one process, copper cyanide and iron chloride baths are used in the plating. Copper cyanide is a highly toxic and tightly regulated material. The iron chloride bath is also a highly toxic and extremely corrosive bath that is very destructive to the equipment around it.

An alternative approach is to insert an iron sleeve into the cylinder bore. Still another approach is to coat the inside of the bore with a suitable metal alloy by thermal spray coating processes and then re-machining the bore. These approaches are estimated to be 8 to 14 times as expensive as piston plating.

The previous methods employ many steps. Examples of the previous art for plating on aluminum may be found in Metal Finishing Guidebook and Directory Issue '92, pages 157–158, and *Electroplating Engineering Handbook, Fourth Edition*, edited by Larry Durney, pages 185–188.

In a recent patent application (application Serial No. 07/959,881, filed Oct. 13, 1992) filed in the name of the present inventor and assigned to the same assignee as the present application, a process of plating iron onto aluminum is disclosed and claimed, using a zincate process. However, while the teachings of that invention are certainly useful, it requires the added zincate step. Further, one cannot plate iron directly onto the zincate layer without an additional adhesion layer such as nickel or copper. The reason for this lies in the mechanism of the zincate itself. Zincate readily deposits an immersion layer on aluminum, but the reduction step to the next metal is limited to those metals that will reduce over the zincate without dissolving and destroying the very thin zinc coating. Also, zincate often requires a postplate bake to enhance the adhesion.

It is desired to provide a method, preferably inexpensive, for plating aluminum pistons with an acceptable iron coating that will pass all the required adhesion, hardness, and abrasion tests without using highly toxic or hazardous substances.

SUMMARY OF THE INVENTION

In accordance with the invention, an iron plating process for plating iron on surfaces of aluminum and aluminum alloys such as 390 aluminum alloy surfaces comprises:

(a) cathodically activating the surface of the substrate in an acid; and (b) plating on the activated surface a layer of iron from an iron sulfate bath.

The method of the present invention removes the need for nitric/hydrofluoric acid etching, a step that until now was considered essential for the successful plating of diecast aluminum/silicon alloy, such as the 390 aluminum. This not only saves a step in the process, but eliminates a highly regulated and potentially harmful chemical (hydrofluoric acid) from the process.

The method of the present invention also eliminates the need for a zincate strike, and the need for a nickel or copper adhesion layer. The present method yields 100% good parts and is easy to use.

The present invention allows the pistons that are going to be manufactured for use with the aluminum engine to be plated much more rapidly and at a considerable cost savings.

BRIEF DESCRIPTION OF THE DRAWINGS

The sole Figure is a schematic drawing of the apparatus used in the practice of the invention.

DESCRIPTION OF THE PREFERRED EMBODIMENTS

The present invention is especially useful for the plating of 390 hyper-eutectic aluminum alloy. However, it is also useful in plating iron onto any aluminum-containing surface.

The method of the present invention involves the direct plating of iron on aluminum, and particularly on 390 aluminum alloy. This method is related to the invention described in U.S. Pat. No. 4,960,493, entitled "Plating on Molybdenum" issued to the present inventor and assigned to the same assignee as the present application.

What is novel in the present invention is the activation of the surface of aluminum, including the 390 aluminum alloy, for electroplating, and particularly for electroplating iron. Activation is necessary to make the surface ready to accept plating. Activation is accomplished by making the aluminum-containing part the cathode in sulfuric acid, and this process is referred to herein as "cathodic acid activation" (CAA). Hydrogen is generated at the cathode, and this probably reduces the surface of the aluminum. It may also form a metal hydride at the surface, but this is a hypothesis that has not yet been proved.

Previous methods used zincate, followed by nickel or copper plating, and then iron plating. This is a very successful method, but at high volumes, every step must be considered. The more steps that can be removed, the quicker the process can run, which means that more parts can be produced in a shorter length of time and at a lower cost. Also, eliminating the nitric/hydrofluoric acid etch step has positive environmental implications.

There are a number of different embodiments that may be followed in the practice of the invention. In the first embodiment, the aluminum part is immersed in a hot non-etching alkaline cleaner to remove grease and oils. The immersion time should be long enough to clean the part, but the time will vary with the amount of oil and grease contamination. Examples of such cleaners include commercially available products, such as dishwashing compositions, CHEMIZID 740, available from Allied-Kelite, and ALKANOX, available from VWR Scientific. The immersion time typically ranges from about 15 seconds to 1 minute. If the part is very oily or greasy, a solvent degrease step may be inserted prior to the alkaline cleaning step. The cleaned parts are then rinsed in cold running water.

Next, the aluminum-containing part is immersed in an acid solution for the cathodic acid activation. The acid solution comprises 15 to 25 vol/vol % sulfuric acid in water at room temperature. As an example, a 20% sulfuric acid solution may be employed. This is the "acid activation cell."

The positive electrode of the power supply is attached to electrodes, which will become the anodes of the acid activation cell. The electrodes may comprise graphite, lead, platinum, or titanium. These electrodes should be at least two times the area of the cathode (part) that will be plated. This is due to gas liberation at the poles. If the anode and cathode ratios are too far apart in size, the solution will evolve oxygen and hydrogen gases rather than complete the cell. The anodes are placed at opposite sides of the tank, and the part (or cathode) is placed between the anodes.

A preferred way to carry out the cathodic acid activation and the subsequent electroplating step is to use two rectifiers set up with the anode or positive wire from one rectifier going to the acid activation cell and the anode or positive wire from the other rectifier going to the iron anodes in the iron plating bath. This way, one can set two different current densities and not waste time trying to change the setting on a rectifier. This arrangement is depicted in the sole Figure.

Two plating tanks 10 and 12 are depicted in the Figure. In the first tank 10 is the acid solution 14 for activation of the surface of the aluminum-containing part 16, which is made the cathode. Anodes 18 and anode connections 18' complete the electroplating circuit.

In the second tank 12 is the iron plating solution 20 in which the aluminum-containing part 16, with its surface having been activated, is immersed. Anodes 22 and anode connections 22' complete the electroplating circuit.

Each plating tank 10, 12 is associated with a power supply, or rectifier, 24, 26, respectively. The negative leads 28, 30, respectively, of both power supplies (when two are used together) are connected and then these wires are connected to the part 16. This connection makes the part 16 the cathode. The heavy lines associated with 28 and 30 depict the cathode position when the part 16 is immersed in the acid activation bath, while the light lines associated with 28' and 30' depict the cathode position when the part is immersed in the iron plating bath.

The part 16 is immersed in the 20% sulfuric acid activation bath 14 with the voltage already turned up to 6 volts minimum, in order to activate the cell. The target current density is at least about 200 amps per square foot (21.5 A/dm$^2$), in order to achieve the desired activation. The dwell time is about 15 to 20 seconds. Too long a period of time causes erosion of the part, while too short a period of time will not provide a sufficient activation of the aluminum-containing surface.

With the cathode (negative leads 28, 30) still attached to the part 16, the part is transferred immediately into the iron plating bath 20 preset at about 40 amps per square foot (4.31 A/dm$^2$), and the part is plated for the amount of time required to build up the required plating thickness. The current density is one that is commonly employed in the industry. The plating time is based on Faraday's law and the cathode efficiency. Using an iron bath with a concentration of 450 grams per liter of ferrous ammonium sulfate takes approximately 20 minutes to deposit an iron coating with a thickness of 0.001 inch.

The iron plating bath may comprise any of the well-known iron plating baths. Preferably, the composition of the iron plating bath comprises an aqueous solution of a ferrous sulfate, such as ferrous ammonium sulfate. The concentration of this plating bath ranges from a value of about 400 to 500 g/L, with the pH of the plating bath ranging from about 1.7 to 2.5. Preferably, the concentration of ferrous ammonium sulfate is about 450 g/L.

The iron plating bath may also include appropriate addition agents, such as wetters, brighteners, and the like, to enhance the plating characteristics. A brightener permits use of higher current densities, which make it possible to plate the part faster. The composition and concentration of such addition agents are well-known in the art and hence do not form a part of this invention.

The anodes comprise any of the anode materials listed earlier in connection with the acid activation cell, and include graphite, lead, platinum, and titanium. A current density of about 20 to 60 amps/ft$^2$ (2.15 to 6.46 A/dm$^2$) is impressed on the aluminum-containing part, as cathode. Preferably, the current is about 40 to 50 amps/ft$^2$ (4.31 to 5.38 A/dm$^2$), which provides the best combination of fast plating time consistent with good visual appearance of the iron plate.

The iron is plated to a thickness of about 0.0002 to 0.0015 inch (0.00051 to 0.0038 cm). A thickness of less than about 0.0002 inch does not provide a sufficiently thick coating of iron for wear, while a thickness of greater than about 0.0015 inch results in an iron layer that is too brittle. The preferred thickness for aluminum alloy pistons is about 0.001 inch (0.0025 cm) of iron per plated surface.

A typical dwell time of about 20 minutes at 40 amps/ft$^2$ (4.31 A/dm$^2$) is used to obtain the desired thickness, although shorter or longer times at lower or higher currents may be employed in the practice of the invention to obtain the desired thickness.

In a second embodiment, the aluminum-containing part is immersed in the hot non-etching alkaline cleaner to remove grease and oils, as above, followed by a rinse in cold running water.

The aluminum-containing part is immersed directly in an iron plating bath (ferrous ammonium sulfate or iron sulfate) for performing a combination activation/strike and plating. The pH is adjusted to 1.7 to 2.5 in order to maintain the iron in solution. Outside this pH range, the iron precipitates. For example, using an iron sulfate plating bath, sulfuric acid may be used to adjust the pH.

The aluminum-containing part is connected to the negative pole of a rectifier capable of 6 volts minimum. The target current density is about 200 amps per square foot. The part is exposed to this current density for 15 to 20 seconds.

After 15 to 20 seconds, the current density is reduced to 20 to 60 amps per square foot (2.15 to 6.46 A/dm$^2$) and maintained at that value for the amount of time to deposit the required thickness of iron plating, as above.

In yet another embodiment, a combination activation and iron strike may be done by employing as the acid activation bath an iron sulfate-containing bath (ferrous ammonium sulfate or iron sulfate) in which the pH is lower than the plating bath, ranging from about 1.3 to 1.5. In the case of a ferrous ammonium sulfate plating bath, the concentration ranges from about 100 to 150 g/L. The strike is performed at 200 amps per square foot (21.5 A/dm$^2$). Then, without rinsing, the part is transferred to a bath formulated for plating, such as described above, and run the required time for the needed thickness.

Aluminum coupons have been plated with iron using the first embodiment and tested by the following methods:

tape test;
chisel test; and
cut and pull test;

In the tape test, a piece of tape is applied to the plated part and pressed down evenly. The tape is pulled away quickly and the coupon is examined for any pulling away of the plated coating.

In the chisel test, an attempt is made to chisel away some of the plating. If any plating comes away, a check is made to see if the base metal is deformed, which would cause a rending of the coating if it had poor adhesion. Essentially, what is being examined is whether the chisel breaks the base metal or merely the base metal/plating metal bond. Breaking the base metal/plating metal bond is an indication of poor adhesion.

In the cut and pull test, the part is sawed in half using a band saw. The edges are then examined for any peeling or pulling away of the plated coating from the base material.

All coupons passed all of the tests.

While the invention has been described in terms of plating 390 aluminum alloy pistons, which is a silicon-aluminum alloy containing about 18% silicon, the teachings of the present invention are equally applicable to the iron plating of other aluminum alloys and of other aluminum alloy parts.

Often, a bake step is employed following electroplating of, for example, iron onto an aluminum alloy. Such a baking step is intended to remove hydrogen embrittlement and to improve adhesion of the plated coating. The bake step is typically carried out at an elevated temperature, such as about 350° to 400° F., typically about 375° F., for a period of time, such as about 1 to 3 hours, typically about 1 hour. While other aluminum alloys, such as 6061, may require baking following plating, 390 aluminum alloy does not appear to require such treatment.

It is very important for many applications, such as iron plating of aluminum alloy pistons, that the iron coating have an acceptable hardness. For pistons, this hardness should be equivalent to a Rockwell hardness of about 40 or higher on the C scale. The practice of this invention provides iron coatings of acceptable hardness for such applications.

390 aluminum alloy pistons plated as above have been tested for adhesion, morphology, hardness, and thickness and have passed all tests. Adhesion tests have been run on test coupons. All coupons passed the tape adhesion test. Microscopic examination of cross-sections have shown the morphology of the deposit to be tight and close-grained. The coupons also showed good adhesion in simple abrasion tests.

The use of cathode acid activation in accordance with the invention does not require the bake step. Also, the activation step eliminates the rinse steps that had to follow the zincate treatment. It also eliminates the nickel or copper plating process and the rinse steps that follow the nickel or copper plating. Furthermore, the activation step eliminates the acid pickle, which was a step required prior to the zincate, and the rinse following that procedure.

Thus, there has been disclosed iron-plated aluminum alloy parts and a process for plating the same. It will be appreciated by those skilled in the art that various changes and modifications of an obvious nature may be made, and all such changes and modifications are considered to fall within the scope of the invention, as defined by the appended claims.

What is claimed is:

1. An iron plating process for plating iron on surfaces of aluminum and aluminum alloy parts, comprising:

(a) cathodically activating said surface of said part in an acid solution to form an activated surface; and (b) plating on said activated surface a layer of iron from an iron sulfate-containing plating bath.

2. The iron plating process of claim 1 wherein said aluminum alloy comprises 390 alloy.

3. The iron plating process of claim 1 wherein said surface of said part is cathodically activated by a process comprising:

(a) providing an electrolytic cell containing said acid solution and having at least one anode therein;

(b) immersing said part in said acid solution and operatively associated with said at least one anode; and (c) applying to said cell a voltage of at least about 6 volts and a current density of at least about 200 amps/ft$^2$ for a period of time ranging from about 15 to 20 seconds.

4. The iron plating process of claim 3 wherein said acid solution comprises 15 to 25 vol/vol% sulfuric acid in water and wherein said part is subsequently immersed in said plating bath.

5. The iron plating process of claim 4 wherein said acid solution comprises about 20% sulfuric acid.

6. The iron plating process of claim 3 wherein said acid solution comprises an iron ammonium sulfate or iron sulfate bath and wherein said part is left in said acid solution for subsequent plating of iron.

7. The iron plating process of claim 6 wherein said acid solution comprises an iron ammonium sulfate bath containing about 400 to 500 g/L iron ammonium sulfate and maintained at a pH ranging from about 1.7 to 2.5.

8. The iron plating process of claim 6 wherein said acid solution comprises an iron ammonium sulfate plating bath comprising about 100 to 150 g/L iron ammonium sulfate and maintained at a pH ranging from about 1.3 to 1.5.

9. The iron plating process of claim 1 wherein said activated surface is plated with iron by a process comprising:

(a) providing an electrolytic cell containing said iron plating bath and having at least one anode therein;

(b) immersing said surface in said iron plating bath and operatively associated with said at least one anode; and (c) applying a voltage of at least about 6 volts and a current density of at least about 20 amps/ft$^2$ for a period of time ranging from about 15 to 40 minutes,

10. The iron plating process of claim 9 wherein said iron plating bath comprises 400 to 500 g/L ferrous ammonium sulfate in water.

11. The iron plating process of claim 10 wherein said iron plating bath comprises about 450 g/L ferrous ammonium sulfate maintained at a pH ranging from about 1.7 to 2.5.

12. An iron plating process for plating iron on surfaces of aluminum and aluminum alloy parts, comprising:

(a) cathodically activating said surface of said part in an acid solution to form an activated surface, said surface being cathodically activated by a process comprising:

(1) providing an electrolytic cell containing said acid solution and having at least one anode therein, (2) immersing said part in said acid solution and operatively associated with said at least one anode, and (3) applying to said cell a voltage of at least about 6 volts and a current density of at least about 200 amps/ft$^2$ for a period of time ranging from about 15 to 20 seconds; and (b) plating on said activated surface a layer of iron from an iron sulfate-containing plating bath by a process comprising:

(1) providing an electrolytic cell containing said iron plating bath and having at least one anode therein, (2) immersing said surface in said iron plating bath and operatively associated with said at least one anode, and (3) applying a voltage of at least about 6 volts and a current density of at least about 20 amps/ft$^2$ for a period of time ranging from about 15 to 40 minutes.

13. The iron plating process of claim 12 wherein said aluminum alloy comprises 390 alloy.

14. The iron plating process of claim 12 wherein said acid solution comprises 15 to 25 vol/vol% sulfuric acid in water and wherein said part is subsequently immersed in said plating bath.

15. The iron plating process of claim 14 wherein said acid solution comprises about 20% sulfuric acid.

16. The iron plating process of claim 12 wherein said iron plating bath comprises 400 to 500 g/L ferrous ammonium sulfate in water.

17. The iron plating process of claim 16 wherein said iron plating bath comprises about 450 g/L ferrous ammonium sulfate maintained at a pH ranging from about 1.7 to 2.5.

* * * * *